US010087749B2

(12) United States Patent
Holt et al.

(10) Patent No.: US 10,087,749 B2
(45) **Date of Patent: *Oct. 2, 2018**

(54) SYSTEM AND METHOD OF TRIGGERING, ACQUIRING AND COMMUNICATING BOREHOLE DATA FOR A MWD SYSTEM

(71) Applicant: Bench Tree Group, LLC, Georgetown, TX (US)

(72) Inventors: Aubrey Holt, Georgetown, TX (US); Michael Brownlow, Georgetown, TX (US); Greg Hill, Austin, TX (US)

(73) Assignee: Bench Tree Group, LLC, Georgetown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/738,153

(22) Filed: Jun. 12, 2015

(65) Prior Publication Data

US 2015/0275656 A1 Oct. 1, 2015

Related U.S. Application Data

(63) Continuation of application No. 14/242,616, filed on Apr. 1, 2014, now Pat. No. 9,062,537.

(51) Int. Cl.
*E21B 47/12* (2012.01)
*E21B 44/00* (2006.01)

(52) U.S. Cl.
CPC ..... *E21B 47/12* (2013.01); *E21B 44/00* (2013.01)

(58) Field of Classification Search
CPC ..... E21B 47/12; E21B 47/18; E21B 47/022; E21B 47/124; E21B 44/00; G01V 11/002
See application file for complete search history.

(56) References Cited

U.S. PATENT DOCUMENTS 4,734,892 A 3/1988 Kotlyar
5,163,521 A * 11/1992 Pustanyk ..... E21B 7/04 175/107
RE35,790 E * 5/1998 Pustanyk ..... E21B 7/04 175/107
5,812,068 A * 9/1998 Wisler ..... E21B 7/068 175/40
5,881,310 A * 3/1999 Airhart ..... E21B 47/124 710/3
6,050,348 A 4/2000 Richardson et al.
7,245,229 B2 7/2007 Baron et al.
(Continued)

OTHER PUBLICATIONS

PCT/US2015/23525 PCT Written Opinion of the International Searching Authority, dated Jul. 21, 2015.
(Continued)

*Primary Examiner* — Orlando Bousono
(74) *Attorney, Agent, or Firm* — Dunlap Codding, P.C.

(57) ABSTRACT

A set of instructions stored on at least one non-transitory computer readable medium running on a computer system having at least one processor. The set of instructions extract outputs from sensors of a measurement while drilling system of a drilling rig; enable a transmitter to transmit a first data stream having at least one data series including drilling data, the first data stream having an interruptible portion encompassing at least a portion of the drilling data; detect a trigger event during transmission of the first data stream; and cease transmission of the first data stream.

4 Claims, 6 Drawing Sheets

(56) References Cited

U.S. PATENT DOCUMENTS 7,510,026 B2 3/2009 Pastusek et al.
7,573,397 B2 8/2009 Petrovic et al.
7,983,113 B2 7/2011 Krueger et al.
2003/0151977 A1* 8/2003 Shah ..... E21B 47/122 367/82
2005/0284659 A1* 12/2005 Hall ..... E21B 44/00 175/27
2006/0077757 A1* 4/2006 Cox ..... G01V 1/40 367/25
2007/0057811 A1 3/2007 Mehta
2008/0083564 A1* 4/2008 Collins ..... E21B 44/04 175/24
2008/0253228 A1* 10/2008 Camwell ..... E21B 47/12 367/82
2009/0115625 A1* 5/2009 Young ..... G01V 11/002 340/854.6
2009/0201170 A1* 8/2009 Reckmann ..... E21B 47/12 340/854.4
2010/0161227 A1* 6/2010 Deere ..... G01V 11/00 702/9
2010/0315901 A1* 12/2010 Coman ..... G01V 1/42 367/35
2011/0017512 A1* 1/2011 Codazzi ..... E21B 47/122 175/40
2011/0018734 A1* 1/2011 Varveropoulos ..... G01V 11/002 340/853.7
2011/0139507 A1* 6/2011 Krueger ..... E21B 43/305 175/45
2011/0172923 A1 7/2011 Van Os et al.
2011/0203846 A1* 8/2011 Degrange ..... G01V 1/46 175/50
2011/0220410 A1 9/2011 Aldred et al.
2012/0330551 A1* 12/2012 Mitchell ..... E21B 47/022 702/9
2013/0228328 A1 9/2013 Chapman
2013/0341092 A1* 12/2013 Hay ..... E21B 7/04 175/24
2014/0240140 A1* 8/2014 Switzer ..... E21B 47/122 340/854.6

OTHER PUBLICATIONS

PCT/US2015/23525 PCT International Search Report, dated Jul. 21, 2015.

* cited by examiner

SYSTEM AND METHOD OF TRIGGERING, ACQUIRING AND COMMUNICATING BOREHOLE DATA FOR A MWD SYSTEM

INCORPORATION BY REFERENCE

The present patent application is a continuation of a patent application identified by U.S. Ser. No. 14/242,616, filed on Apr. 1, 2014 the disclosures of which are hereby incorporated by reference in their entireties.

BACKGROUND

In oil and gas, geothermal drilling, mining, or construction of boreholes, a hole or borehole is drilled deep within the earth for exploration, extraction, or injection of resources such as water, gas, or oil, or for installing cables, fibre, or pipelines (e.g., in construction). Boreholes may be formed using a drill string, wherein sections of drill pipe are connected to a drill bit.

The drill string may include a measurement while drilling (MWD) system having sensors packaged in a section of the drilling string. For example, in some MWD systems, the sensors may be packaged in a section of the drill string near the drill bit. These sensors are generally used to measure parameters or properties of the drilling system, borehole, or formation. In one specific application, the sensors may be used to survey boreholes using downhole survey instruments. The instruments typically contain sets of accelerometers and magnetometer(s) or gyroscope(s) that are coupled within a bottom hole assembly (BHA), which in turn is coupled in the drill string. The survey instruments are used to measure the direction and magnitude of the local gravitational and magnetic field vectors in order to determine the azimuth and the inclination of the borehole at each survey station within the borehole. Generally, discrete borehole surveys are performed at survey stations along the borehole when drilling is stopped or interrupted to add additional joint or stands of drill pipe to the drill string at the surface.

Sensing modules are also used to provide operators with information regarding the drilling operation as the drilling progresses. In such operations, information regarding the drilling system, borehole, and/or formation characteristics may be provided to an operator in close to real time. Such information may include toolface, shock & vibration, resistivity, radioactivity, porosity, density, and the like.

With MWD operations, the downhole component(s) of the MWD system(s) generally transmit the information to the surface component of the MWD system for analysis. For example, information may be transmitted using mud pulse telemetry, electromagnetic communications, acoustic communications, and/or the like.

Typical drilling activity induces various types of noise, such as vibration or magnetic interference. The noise may be detrimental to the precise measurements needed to obtain a borehole survey. As such, in a typical MWD system, the survey is acquired at particular intervals at which the MWD system autonomously determines drilling activity has been paused. Within the prior art, most systems monitor the state of mud pumps (located on the surface) to determine if activity has been paused.

Mud pumps circulate fluid through the drill string and back around the annular space between the drill string and the borehole. Fluid circulated through this hydraulic circuit is intended to lubricate the drill string and clean drill cuttings from the borehole.

The MWD system usually processes measurements from pressure sensors, accelerometers or flow sensors to determine the state of the mud pump(s). For example, changes in ambient pressure, pressure differential, pressure signatures unique to the mud pumps, and the like, may be used to determine the state of the mud pump. Additionally, fluid flow through or around the MWD system may also induce acoustic noise, vibrations, and the like, that may be used to determine the state of the mud pump in some MWD systems.

In drilling operations, the state at which mud pumps are 'off' (i.e., not circulating fluid through and around the drill string), is sometimes referred to as the 'flow off' state, as drilling fluid is generally not circulating or flowing through the mud pump system. A 'flow on' state is therefore one at which the mud pump system is presumably 'on' and drilling fluid is circulating or flowing.

In some drilling operations, the mud pump system may be maintained in a "flow on" state in order to lubricate and/or clean the borehole. For example, the mud pump system may be maintained in a "flow-on" state to prevent the drill string from getting stuck within the borehole, or to manage the drilling system pressure (i.e., managed pressure drilling).

In a lost circulation event, a significant amount of fluid may continue to flow through or around the MWD system, even when the mud pump system is in a "flow off" state at the surface. That is, the MWD system may continue to determine a "flow on" state, and as such, will not acquire a survey even if needed. There is also an assumption that in the "flow off" state, the environment is quiet enough to obtain a high quality survey. Even if a "flow off" state is determined, errors from motion due to lost circulation, drill string unwinding, motion interference, or magnetic interference may still lead to a survey not being acquired or to an inaccurate survey.

Even further, improvements in telemetry within the art may permit real-time transmission of data; however, not all data may be sent at once, and as such, decisions on what data to send in real time becomes a consideration. For example, the more data sent uphole, the slower the update rate of each measurement, limiting access to the right data at the right time.

SUMMARY

In some embodiments, the present disclosure is directed to a set of instructions stored on at least one computer readable medium running on a downhole computer system of a measurement while drilling (MWD) system of a drilling rig within a borehole. The downhole computer system has at least one processor. The set of instructions are provided with: instructions for extracting outputs from sensors of the MWD system of the drilling rig, wherein extracting further includes determining at least one group of data including drilling data from the output of the sensors; instructions for enabling a transmitter to transmit a first data stream having at least one group of data including drilling data, the first data stream having an interruptible portion encompassing at least a portion of the drilling data in the at least one group of data to a surface computer system of the MWD system; instructions for detecting a predetermined event during transmission of the first data stream; instructions for interrupting the transmission of the first data stream during the interruptible portion of the first data stream; and, instructions for enabling the transmitter to transmit a second data stream.

In another embodiment, the present disclosure describes a set of instructions stored on at least one computer readable medium running on a computer system. The computer system has at least one processor. The set of instructions is provided with: instructions for extracting outputs from sensors of a measurement while drilling system of a drilling rig; instructions for enabling a transmitter to transmit a first data stream having at least one data series including drilling data, the first data stream having an interruptible portion encompassing at least a portion of the drilling data; and, instructions for detecting a trigger event during transmission of the first data stream and ceasing transmission of the first data stream.

In this embodiment, the set of instructions may further include instructions for transmitting a second data stream. The second data stream may include drilling data that is different than the first data stream. The set of instructions may further include instructions for providing a survey delay between the detection of the trigger event and extraction of the output from the sensors resulting in acquisition of survey data.

In some embodiments, the present disclosure describes a method of transmitting survey data and drilling data of a drilling rig measurement while drilling (MWD) system. In this method, a downhole computer system initiates transmission of a signal stream including a first survey data series and a first drilling data series. The transmission occurs during a first rotational state of at least one of a drill string and a drill bit of the drilling rig. The drilling rig alters the first rotational state of the at least one of the drill string and the drill bit and the downhole computer system ceases transmission of the signal stream based on the alteration of rotation. The downhole computer system determines whether a second survey data series is stored in memory of the downhole computer system; and, transmits at least one of the second survey data series and a second drilling data series to a surface computer system.

In some embodiments, the present disclosure describes a method of transmitting drilling data by a measurement while drilling (MWD) system of a drilling rig. In this method, a downhole computer system receives sensor data. The downhole computer system determines a first drilling data series and a second drilling data series from the sensor data. The downhole computer system initiates transmission of the first drilling data series and determines a state of the drilling rig. The downhole computer system interrupts transmission of the first drilling data series based on a state change of at least one downhole component of the drilling rig, wherein the second drilling data series is received by the downhole computer system subsequent to the state change of at least one downhole component of the drilling rig; and, initiates transmission of the second drilling data series.

The state change of the at least one downhole component may include a rotational state change of the drilling rig. The second drilling data series may be different from the first drilling data series. The second drilling data series may be a quantitative update of the first drilling data series.

In some embodiments, the present disclosure describes a system for acquiring and transmitting survey data and drilling data of a drill rig and borehole, the system is provided with a plurality of sensors, and a computer system. A plurality of sensors obtains survey data and drilling data at discrete instants of time; at least one sensor obtains rotation data regarding rotation mode of the drill rig. The computer system communicates with the plurality of sensors, and executes software. The computer system reads at least one memory location storing the survey data obtained at the discrete instants of time; at least one memory location storing the drilling data obtained at the discrete instants of time; and, at least one memory location storing rotation data. The software executed by the computer system causes the computer system to determine transmission of the drilling data based on the discrete instants of time in which the drilling data was obtained and the rotation mode of the drilling rig.

In some embodiments, the present disclosure describes a set of instructions stored on at least one computer readable medium running on a surface computer system of a measurement while drilling (MWD) system of a drilling rig. The surface computer system has at least one processor. The set of instructions include instructions for receiving a first data stream by a receiver of the surface computer system; instructions for detecting a synchronization signal indicative of an interruption of the transmission of the first data stream due to the occurrence of a predetermined event at an unexpected time, and synchronizing the receiver with the synchronization signal; and instructions for receiving a second data stream by the receiver, in which the second data stream has at least one group of data including drilling logging data.

BRIEF DESCRIPTION OF THE SEVERAL VIEWS OF THE DRAWINGS

To assist those of ordinary skill in the relevant art in making and using the subject matter hereof, reference is made to the appended drawings, which are not intended to be drawn to scale, and in which like reference numerals are intended to refer to similar elements for consistency. For purposes of clarity, not every component may be labeled in every drawing.

DETAILED DESCRIPTION

Figure 1:
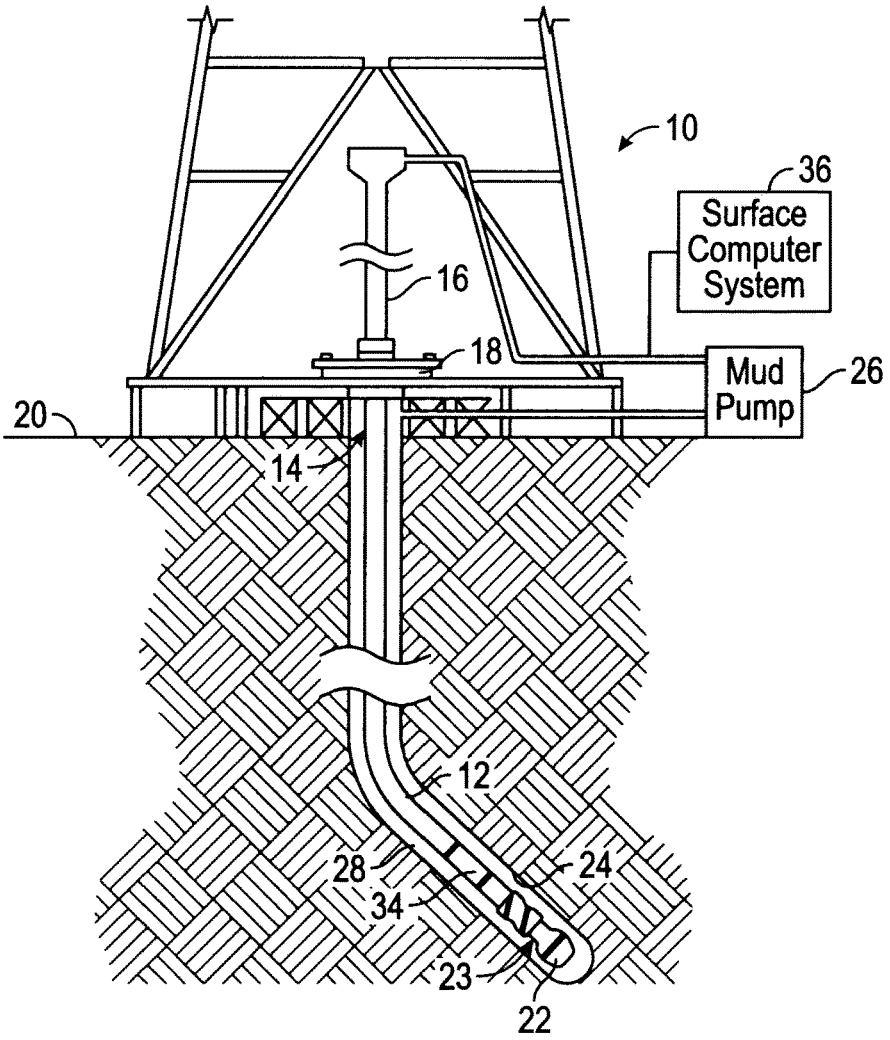
FIG. 1 illustrates a schematic diagram of an exemplary embodiment of a drill rig having a drill string positioned in a borehole in accordance with the present disclosure.

Before explaining at least one embodiment of the disclosure in detail, it is to be understood that the disclosure is not limited in its application to the details of construction, experiments, exemplary data, and/or the arrangement of the components set forth in the following description or illustrated in the drawings unless otherwise noted.

The disclosure is capable of other embodiments or of being practiced or carried out in various ways. Also, it is to be understood that the phraseology and terminology employed herein is for purposes of description, and should not be regarded as limiting.

The following detailed description refers to the accompanying drawings. The same reference numbers in different drawings may identify the same or similar elements.

As used in the description herein, the terms "comprises," "comprising," "includes," "including," "has," "having," or any other variations thereof, are intended to cover a non-exclusive inclusion. For example, unless otherwise noted, a process, method, article, or apparatus that comprises a list of elements is not necessarily limited to only those elements, but may also include other elements not expressly listed or inherent to such process, method, article, or apparatus.

Further, unless expressly stated to the contrary, "or" refers to an inclusive and not to an exclusive "or". For example, a condition A or B is satisfied by one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more, and the singular also includes the plural unless it is obvious that it is meant otherwise. Further, use of the term "plurality" is meant to convey "more than one" unless expressly stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

Circuitry, as used herein, may be analog and/or digital components, or one or more suitably programmed processors (e.g., microprocessors) and associated hardware and software, or hardwired logic. Also, "components" may perform one or more functions. The term "component," may include hardware, such as a processor (e.g., microprocessor), an application specific integrated circuit (ASIC), field programmable gate array (FPGA), a combination of hardware and software, and/or the like.

Software may include one or more computer readable instructions that when executed by one or more components cause the component to perform a specified function. It should be understood that the algorithms described herein may be stored on one or more non-transient memory. Exemplary non-transient memory may include random access memory, read only memory, flash memory, and/or the like. Such non-transient memory may be electrically based, optically based, and/or the like.

It is to be further understood that, as used herein, the term user is not limited to a human being, and may comprise, a computer, a server, a website, a processor, a network interface, a human, a user terminal, a virtual computer, combinations thereof, and the like, for example.

Figure 2:
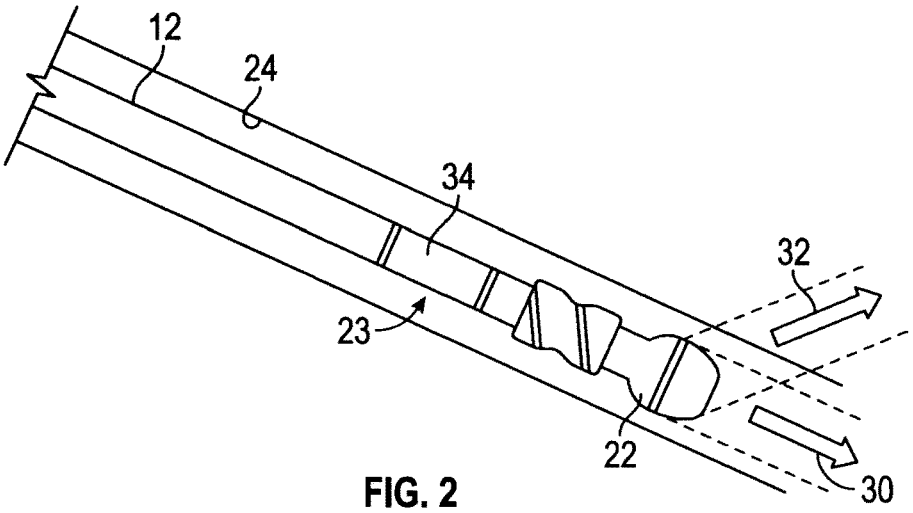
FIG. 2 illustrates an enlarged view of a distal end of the drill string illustrated in FIG. 1 showing movement of a drill bit in rotary mode and sliding mode.

Referring now to the Figures, and in particular to FIGS. 1 and 2, shown therein are illustrations of a drilling rig 10 having drill string 12 interconnected at one or more sections. A proximal end 14 of the drill string 12 may be secured to a kelly joint 16. A rotary table 18 may be used to rotate the drill string 12 during advancement of the drill string 12 within the earth 20. A drill bit 22 is positioned on a distal end 23 of the drill string 12. The drill bit 22 is advanced through surrounding earth 20 forming a bore 24.

The drilling rig 10 may include a mud pump 26. The mud pump 26 may include, for example, one or more pistons providing mud to flow through the drill string 12 and to the distal end 23 of the drill string 12. It should be noted the mud pump 26 may use other techniques for providing mud to flow through the drill string 12 and/or the distal end 23 of the drill string 12. The mud may flow out through the drill bit 22 and return to the surface through an annulus 28 formed between the bore 24 and the drill string 12.

Referring to FIGS. 1 and 2, the drill string 12 and drill bit 22 may be rotated from the surface by the rotary table 18. In some embodiments, the drill string 12 and the drill bit 22 may be rotated using a topdrive. Generally, rotation from the surface via the rotary table is known as rotary mode. In rotary mode, the drill bit 22 may provide a straight path parallel to the axis of the trajectory of the drill bit 22, and/or the like, as illustrated in FIG. 2 by arrow 30. In rotary mode, pointing and/or alterations in hole direction may also be induced using a rotary steerable system in the bottom hole assembly as known in the art. In addition, a rotary steerable system and a mud motor may be integrated or used in combination.

When mud is flowing, generally the drill bit 22 may be rotated but not the drill string 12. For example, a mud motor may be positioned at the distal end 23 of the drill string 12. The mud motor may use power from mud flowing downhole to rotate the drill bit 22. This type of drilling is generally called sliding mode, as the drill string 12 slides along after the drill bit 22. As is known in the industry, a housing bent at a particular angle (e.g., bend in the mud motor housing) may be added to the drill string 12 such that the drill bit 22 may deviate (i.e., point) in the direction that the bent housing directs in sliding mode. The larger the angle of the bend, the sharper the curvature of the trajectory. Arrow 32 illustrates an exaggerated trajectory of a path of the drill bit 22 in sliding mode.

Figure 3:
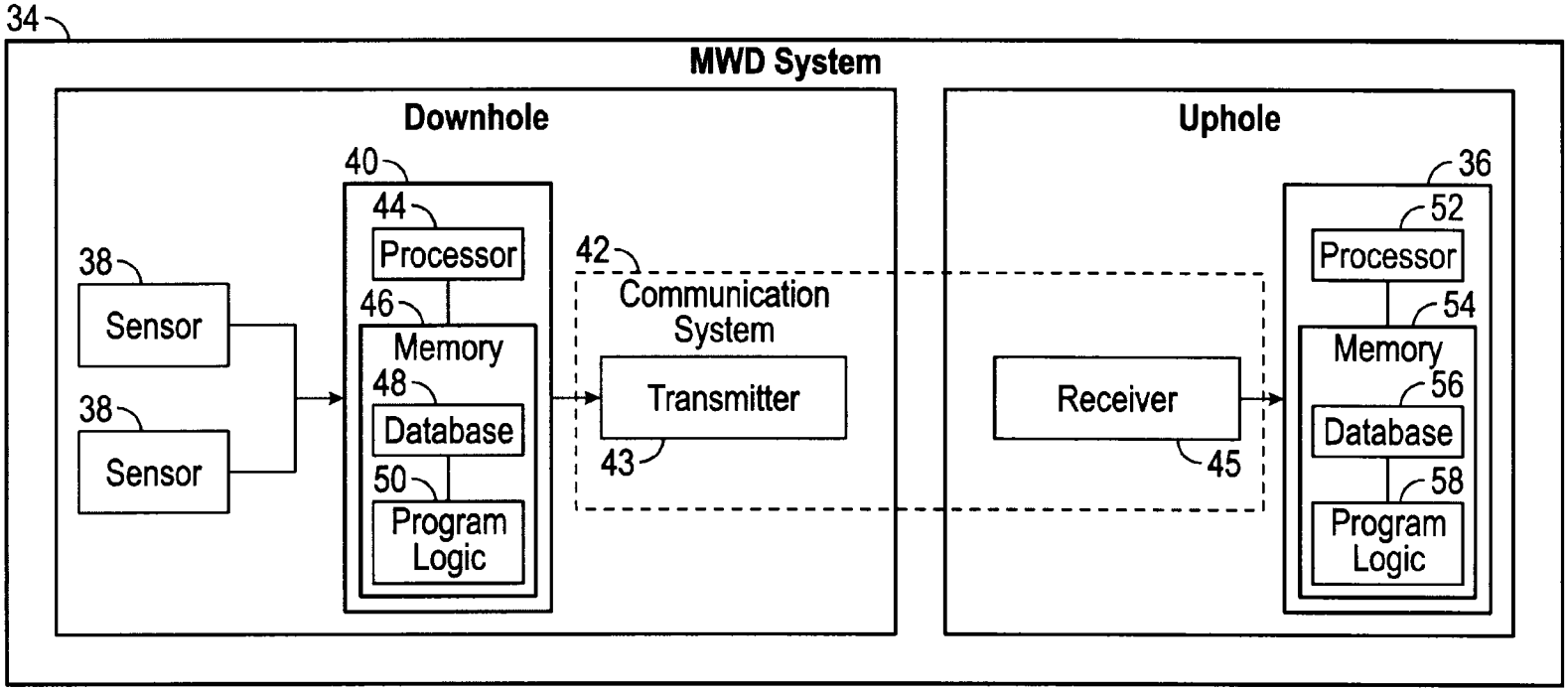
FIG. 3 illustrates a block diagram of a measurement while drilling system positioned downhole in communication with a surface computer system at the surface of the drill rig.

Referring to FIGS. 1 and 3, the direction at which the drill bit 22 is pointing (i.e., drilling orientation) may be measured by a measurement while drilling (MWD) system 34. The MWD system 34 may include a surface computer system 36 and a downhole computer system 40 communicating via a communication system 42. Generally, the MWD system 34 may provide measurements to a user during drilling of the drilling rig 10. For example, one or more data series, such as a survey data series, drilling data series (e.g., tool face data series, gamma data series, gamma azimuth data series), and/or the like, may be measured by the downhole computer system 40 and communicated via the communication system 42 to the surface computer system 36.

Each data series may include one or more data orders (e.g., $D_1$, $D_2$ . . . $D_N$). Each data order may include information regarding a particular property, geometry, state, and/or the like of the wellbore and/or drilling rig 10. For example, a survey data series may include one or more data orders. A data order within the survey data series may be, for example, inclination. Another data order within the survey data series may be, for example, azimuth. Data orders within the survey data series may include, but are not limited to, pressure, temperature, shock & vibration, formation properties (e.g., porosity, resistivity, natural gamma ray, conductivity, neutron), well bore geometry (inclination, azimuth), and/or the like. Data orders within drilling data may include, but are not limited to, drilling system orientation, pressure, temperature, shock & vibration, formation properties, and/or the like.

Referring to FIGS. 1-3, the MWD system 34 may include one or more sensors 38, one or more downhole computer systems 40, and the communication system 42. Generally, the one or more downhole computer systems 40 use the sensors 38 to determine data, such as data indicative of location and orientation (e.g., inclination, azimuth) within the borehole 24. The data is then transmitted as one or more data orders within one or more data series by the communication system 42 to the surface computer system 36 via mud pulse telemetry, electromagnetic telemetry, acoustic telemetry, and/or the like.

The one or more sensors 38 may also provide data regarding formation properties (e.g., porosity, resistivity, natural gamma ray, conductivity, neutron), well bore geometry (e.g., inclination, azimuth), drilling system orientation (e.g., tool face), and drilling parameters (e.g., pressure, temperature, rate of penetration, rotating speed, mechanical efficiency logs, sticking pipe indicator, strain gauge, temperature, pressure, shock and vibration, power information, warning flags). Additionally, the downhole computer system 40 may use the data to form one or more data orders of a data series.

In some embodiments, at least one sensor 38 may provide data regarding rotation mode of the drilling rig 10. For example, the at least one sensor 38 may provide data to the downhole computer system 40. The downhole computer system 40 may use the data to determine whether the drilling rig 10 is in rotary mode, sliding mode, if the drill string 12 and/or drill bit 22 is currently rotating, and/or the like.

The MWD system 34 may utilize the communication system 42 to transfer data from the downhole computer system 40 to the surface computer system 36. The communication system 42 may include a transmitter 43 and a receiver 45. The transmitter 43 may transmit one or more data series from the downhole computer system 40 to the receiver 45. The receiver 45 receives, decodes and/or provides the one or more data series to the surface computer system 36.

The communication system 42 may include circuitry and equipment to transfer the data using techniques known in the art. For example, the communication system 42 may include circuitry and equipment for mud pulse telemetry, electromagnetic telemetry, acoustic telemetry, and/or the like. In some embodiments, the communication system 42 may use mud pulse telemetry. Mud pulse telemetry uses circuitry and equipment well known in the art to control a valve which provides pressure pulses in the drilling mud travelling from the near the downhole computer system 40 to the surface computer system 36. It should be noted that it is contemplated that other current and future developed communication systems 42, including acoustic, hard wired and/or wireless systems, may be utilized in the transfer of data from the downhole computer system 40 to the surface computer system 36.

Referring to FIG. 3, the downhole computer system 40 and the surface computer system 36 may be a system or systems that are able to embody and/or execute the logic of the processes described herein. Logic embodied in the form of software instructions and/or firmware may be executed on any appropriate hardware. For example, logic embodied in the form of software instructions and/or firmware may be executed on dedicated system or systems, on a single processing computer system, a distributed processing computer system, and/or the like. In some embodiments, logic may be implemented in a stand-alone environment operating on a single computer system and/or logic may be implemented in a networked environment such as a distributed system using multiple computers and/or processors.

The downhole computer system 40 and the surface computer system 36 may each include one or more processors 44 and 52 (e.g., microprocessors) working together, or independently to, execute processor executable code, and may each include one or more memories 46 and 54 capable of storing processor executable code.

Each element of the downhole computer system 40 may be partially or completely network-based or cloud based, and may or may not be located in a single physical location downhole. Similarly, each element of the surface computer system 36 may be partially or completely network-based or cloud based, and may or may not be located in a single physical location on the surface.

In some embodiments, in the downhole computer system 40, the one or more processors 44 may communicate with each sensor 38 via a network. As used herein, the terms "network-based", "cloud-based", and any variations thereof, are intended to include the provision of configurable computational resources on demand via interfacing with a computer and/or computer network, with software and/or data at least partially located on the computer and/or computer network.

An I/O port and/or the network may permit bi-directional communication of information and/or data between the one or more processors 44, the sensors 38, and the communication system 42. The I/O ports and/or the network may interface with the one or more processors 44, the sensors 38, and the communication system 42 in a variety of ways. For example, interfacing may be by optical and/or electronic interfaces, one or more buses and/or may use a plurality of network topographies and/or protocols. For example, in some embodiments, the network may be implemented as a local area network (LAN), or a wireless network. Additionally, the I/O port and/or the network may use a variety of protocols to permit bi-directional interface and/or communication of data and/or information between the one or more processors 44 the sensors 38, and the downhole communication system 42.

Each of the one or more processors 44 and 52 may be implemented as a single processor or multiple processors working together, or independently, to execute the logic as described herein. It is to be understood, that in certain embodiments using more than one processor 44 within the downhole computer system 40, the processors 44 may be located remotely from one another, located in the same location, or comprising a unitary multi-core processor. Similarly, using more than one processor 52 within the surface computer system 36, the processors 52 may be located remotely from one another, located in the same location, or comprising a unitary multi-core processor. The processors 44 may be capable of reading and/or executing processor executable code and/or capable of creating, manipulating, retrieving, altering and/or storing data structure into the one or more memories 46 and 54 respectively.

Exemplary embodiments of the one or more processors 44 and 52 may include, but are not limited to, a digital signal processor (DSP), a central processing unit (CPU), a field programmable gate array (FPGA), a microprocessor, a multi-core processor, combinations thereof, and/or the like, for example. The one or more processors 44 and 52 may be capable of communicating with the one or more memories 46 and 54 respectively via a path (e.g., data bus).

The one or more memories 46 and 54 may be capable of storing processor executable code. Additionally, the one or more memories 46 and 54 may be implemented as a conventional non-transient memory. For example, the one or more memories 46 and 54 may be implemented as random access memory (RAM), a CD-ROM, a hard drive, a solid state drive, a flash drive, a memory card, a DVD-ROM, a floppy disk, an optical drive, combinations thereof, and/or the like.

In some embodiments, one or more memories 46 of the downhole computer system 40 may be located in the same physical location as the one or more processors 44, and/or one or more memories 46 may be located remotely from the one or more processors 44. Similarly, one or more memories 54 of the surface computer system 36 may be located in the same physical location as the one or more processors 52, and/or one or more memories 54 may be located remotely from the one or more processors 52. For example, one or more memories 54 may be located remotely from the one or more processors 52 and communicate with the one or more processors 52 via a network, e.g., a local area network or a wide-area network such as the internet. Additionally, when more than one memory 46 is used in the downhole computer system 40, a first memory may be located in the same physical location as the processor 44, and additional memories 46 may be located in a remote physical location from the processor 44. Similarly, when more than one memory 54 is used in the surface computer system 36, a first memory may be located in the same physical location as the processor 52, and additional memories 54 may be located in a remote physical location from the processor 52.

The one or more memories 46 and 54 may store processor executable code and/or information comprising one or more database 48 and 56, respectively, and program logic 50 and 58, respectively. In some embodiments, the processor executable code may be stored as a data structure, such as a database and/or a data table, for example. In some embodiments, outputs of the sensors 38 may be stored in one or more databases and/or data tables within the one or more memories 46.

The downhole computer system 40 may initiate transmission a signal stream having one or more data series by the processor 44 commanding the transmitter 43 of the communication system 42 to send the data. Data may be transmitted as a series of signals by mud pulse telemetry, electromagnetic telemetry, acoustic telemetry and/or the like. For example, in some embodiments, the data may be transmitted using mud pulse telemetry, with the series of signals being pulses.

In general, the sensors 38 of the MWD system 34 may provide data to the downhole computer systems 34. Using the sensor data, the downhole computer system 34 may determine one or more data series (e.g., survey data series, drilling data series) having one or more data orders (e.g., inclination, azimuth, magnetic field, gravity field). Each data series may be stored in the downhole computer system 40 for transmission as a signal stream to the surface computer system 36 via the transmitter 43 of the communication system 42. Each data series may be capable of being received by the receiver 45 of the communication system 42.

FIGS. 4-7 illustrate exemplary embodiments of signal streams for providing one or more data series (e.g., survey data series, drilling data series) each having one or more orders from the downhole computer system 40 to the surface computer system 36 via the communication system 42. In some embodiments, transmission of drilling data (e.g., tool face) from the downhole computer system 40 to the surface computer system 36 via the communication system 42 may be uninterrupted in that the acquisition and transmission of a first data series (e.g., a first drilling data series) may be immediately followed by acquisition and transmission of a second data series (e.g., a second drilling data series).

In some embodiments, transmission of a second data series (e.g., drilling data series, survey data series) may be triggered by a predetermined event and transmitted thereby interrupting the transmission of the first data series. The predetermined event may be detected by the downhole computer system 40 and may include, but is not limited to, a change in rotation of the drill string 12 and/or the drill bit 22 of the drilling rig 10 (e.g., no rotation to rotation, a differential measurement between two rotation speeds exceeding a predetermined amount), increasing weight on bit, flow rate of the mud pump, a command received by at least one of electromagnetic transmission, mud pulse telemetry transmission, and/or the like.

Figure 4:
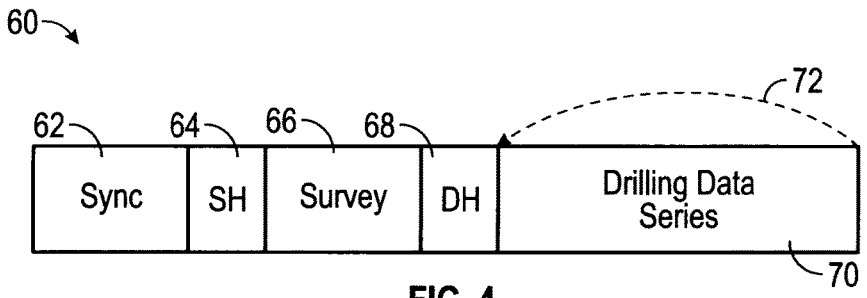
FIG. 4 illustrates an exemplary embodiment of a signal series for transmitting survey data and drilling data in accordance with the present disclosure.

FIG. 4 illustrates an exemplary signal stream 60 for providing data series from the downhole computer system 40 to the surface computer system 36 via the communication system 42 illustrated in FIG. 2. In particular, FIG. 4 illustrates an exemplary signal stream 60 wherein a survey data series 64 and a drilling data series 70 are provided from the downhole computer system 40 to the surface computer system 36 via the communication system 42. Although survey data series and drilling data series are depicted in FIG. 4, one skilled in the art will appreciate that any data series having any number of orders may be used rather than one or both of the survey data series 64 and the drilling data series 70.

As illustrated in FIG. 4, the initiation of the signal transmission may include a synchronization (sync) signal 62. The sync signal 62 provides a reference for correlating a time sequence between the downhole computer system 40 and the surface computer system 36. Generally, the sync signal 62 may be transmitted by the transmitter 43 of the communication system 42 to the receiver 45. The receiver 45 may provide the sync signal 62 to the surface computer system 36. In some embodiments, format of the sync signal 62 may conform to current industry practice. Additionally, future formats for synchronization signals within the industry are contemplated and may be implemented within the signal stream 60.

It should be noted that the surface computer system 36 may be able to detect the sync signal 62 within the signal stream 60 upon receipt. As such, receipt and/or detection of the sync signal 62 by the surface computer system 36 are not predicated upon a prior action within the signal stream 62 (e.g., drilling loop). The surface computer system 36 may thus be able to detect the sync signal 62 subsequent to a predetermined event (e.g., a state change in at least one downhole component of the drilling rig 10).

The signal stream 60 may include a first data header signal. For example, in FIG. 4, the signal stream 60 includes a survey header signal 64. The survey header signal 64, when transmitted, may indicate to the surface computer system 36 that survey data will follow, and may also indicate what type of data may be transmitted within the survey data.

Following the survey header signal 64, a survey data series 66 may be transmitted in the signal stream 60. The survey data series 66 may include one or more data orders. For example, the survey data series 66 may include, but is not limited to, inclination data, azimuth data, magnetic field data, gravity field data, and/or the like.

In some embodiments, the user may be able to request via the communication system 42 one or more data orders for inclusion within the survey data series 66. For example, the survey data series 66 may include data order $D_1$, data order $D_2$, and data order $D_3$. The user may request, via the surface computer system 36, the inclusion of one or more additional data orders (e.g., data order $D_4$, data order $D_5$), the removal of one or more data orders (e.g., data order $D_1$, data order $D_2$), and/or the like, providing a dynamic survey data series. In some embodiments, the request by the user may be initiated during drilling operations.

The survey data series 66 may be followed by a second header signal. For example, in FIG. 4, the survey data series 66 is followed by a drilling header signal 68. Similar to the survey header signal 64, the drilling header signal 68, when transmitted, may indicate to the surface computer system 36 that drilling data will follow, and may also indicate what type of data may be transmitted within the drilling data.

The drilling header signal 68 is followed by a second data series. For example, in FIG. 4, the drilling header signal 68 is followed by a first drilling data series 70 transmitted in the signal stream 60. The first drilling data series 70 may include one or more data orders having drilling system orientation data, and/or the like.

Once transmission of the first drilling data series 70 is complete, the signal stream 60 may immediately transmit a second drilling data series as shown by arrow 72 in FIG. 4. The second drilling data series is different from the first drilling data series. In some embodiments, the second drilling data series may be a quantitative update of the first drilling data series 70. For example, the first drilling data series 70 may include the same data orders as the second drilling data series; however, the data within each data order may be different in the second drilling data series.

In some embodiments, the data forming the first drilling data series may be acquired at a first instant of time in a first location within the borehole and the data forming the second drilling data series may be acquired at a second instant of time in a second location within the borehole. In all cases discussed above, this process may be repeated for additional drilling data series as indicated by arrow 72.

Figure 5:
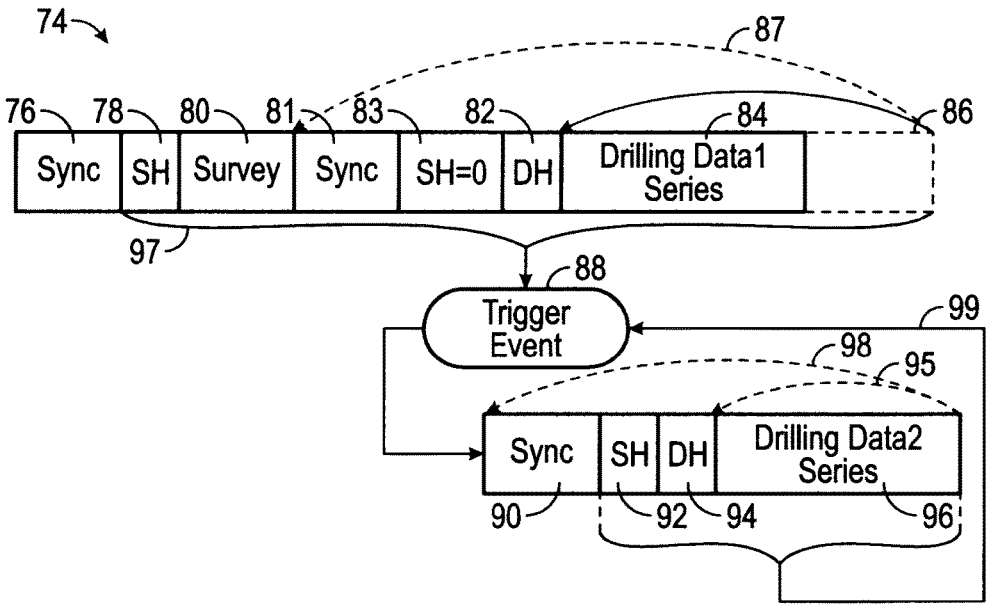
FIG. 5 illustrates an exemplary embodiment of another signal series for transmitting survey data and drilling data in accordance with the present disclosure wherein transmission of drilling data is interrupted by a rotation change of a drill rig.

FIG. 5 illustrates another exemplary signal stream 74 for providing data series having one or more data orders from the downhole computer system 40 to the surface computer system 36 via the communication system 42 illustrated in FIG. 2. For example, FIG. 5 illustrates a survey data series 80, a first drilling data series 84, and second drilling data series 96 in the signal stream 74 provided from the downhole computer system 40 to the surface computer system 36 via the communication system 42 illustrated in FIG. 2. In the signal stream 74, transmission of the data series may be interrupted. In particular, the downhole computer system 40 may interrupt transmission after detection of a trigger event (i.e., a predetermined event detected and/or determined by the downhole computer system 40).

Trigger events may include, but are not limited to, a change in rotation of the drill rig (e.g., no rotation to rotation, differential measurement between two rotation speeds exceeding a predetermined threshold, evaluation of rotation time), increasing weight on bit, flow rate of the mud pump, a command provided by electromagnetic transmission, mud pulse telemetry transmission, a combination thereof and/or the like. For example, a change in the rotation state of the drilling rig 10 (shown in FIG. 1) may trigger transmission of the drilling data series. In particular, a change in the rotation state may trigger interruption of the first drilling data series 84 currently being transmitted in order to transmit the second drilling data series 96. In some embodiments, rotation change 88 may include cessation of rotation of the drill string 12, drill bit 22, and/or the like. In some embodiments, rotation change 88 may include a change in rotation state, such as a change from rotary mode to sliding mode.

The initiation of the signal transmission of the signal stream 74 may include a synchronization (sync) signal 76. The sync signal 76 provides a reference for correlating time between the downhole computer system 40 and the surface computer system 36.

The signal stream 74 may include a header signal. For example, the signal stream 74 in FIG. 5 includes the survey header signal 78. Similar to the survey header signal 64 of FIG. 4, the survey header signal 78, when transmitted, may indicate to the surface computer system 36 that survey data will follow, and may also indicate what type of data may be transmitted within the survey data.

Following the survey header signal 78, a survey data series 80 may be transmitted in the signal stream 74. The survey data series 80 may include one or more data orders. For example, the survey data series 80 may include an inclination data order, an azimuth data order, a magnetic field data order, a gravity field data order, and/or the like. In some embodiments, the survey data series 80 may be a dynamic survey data series as described in further detail herein.

In some embodiments, the survey data series 80 may be followed by a resynchronization (resync) signal 81. Similar to the synchronization signal 76, the resynchronization (resync) signal 81 may provide a reference for correlating time between the downhole computer system 40 and the surface computer system 36. It should be noted that the resync signal 81 may be optional and dependent upon need and/or use of the signal stream 74. Additionally, a survey header signal 83 may be included within the signal stream 74 to indicate to the surface computer system 36 that a survey will not be provided in the immediate transmission.

The survey data series 80 may be followed by a second header signal. For example, in FIG. 5, the survey data series 80 is followed by the drilling header signal 82. The drilling header signal 82, when transmitted, may indicate to the surface computer system 36 that drilling data will follow, and may also indicate what type of data may be transmitted within the drilling data.

The drilling header signal 82 is followed by a first drilling data series 84 transmitted in the signal stream 74. The first drilling data series 84 may include drilling system orientation and/or the like.

Detection of a trigger event 88 (e.g., rotation change) by the processor 44 from data generated by the one or more sensors 38 or received by a receiver (not shown) of the communication system 42 serves as a trigger to the downhole computer system 40. As a trigger, the detection of the trigger event 88 by the processor 44 may cause a branch in the logic to provide a command to control acquisition and/or transmission of data thereby altering the signal stream 74. For example, in the signal stream 74, detection of the trigger event 88 causes the processor 44 to interrupt transmission of the first drilling data series 84 for transmission of a second drilling data series 96, which may be preceded by an optional delay (e.g., sixty second delay), a resynchronization (resync) signal 90, a survey header signal 92, and a drilling header signal 94. The processor 44 supplies data to the transmitter 43 of the communication system 42, while monitoring the sensors 38 and the communication system 42 for the trigger event 88 during an interruptible portion 97 of the signal stream 74 wherein detection of the trigger event 88 causes the processor 44 to interrupt transmission of the signal stream 74. Generally, the interruptible portion 97 may include signal transmission within the signal stream 76 of the survey header 78, survey data series 80, drilling header 82, and drilling data series 84.

Referring to FIG. 5, the transmission of the first drilling data series 84 may be interrupted such that a portion 86 of the data may not be transmitted to the surface computer system 36. The portion 86 may include one or more data orders. In some embodiments, upon detection of the trigger event 88, the signal stream 74 may continue to transmit the current data order prior to interruption of the signal stream 74. In some embodiments, upon detection of the trigger event 88, the signal stream 74 may immediately cease transmission of the current data order. The current data order is a discrete amount of data, such as a data word.

In some embodiments, the trigger event 88 detected by the downhole computer system 40 may provide for transmission of the second resynchronization (resync) signal 90, the survey header signal 92, the drilling header signal 94, and the second drilling data series 96. In some embodiments, one or more transmission delays may be included within the signal stream 74. For example, an optional transmission delay (e.g., sixty second delay) may be included prior to the resynchronization (resync) signal 90.

In some embodiments, the transmission of the second drilling data series 96 may be preceded by the resynchronization (resync) signal 90. Similar to the sync signal 76, the resynchronization (resync) signal 90 may provide a reference for correlating time between the downhole computer system 40 and the surface computer system 36.

The surface computer system 36 may be able to detect the sync signal 76 and resync signal 90 within the signal stream 74 upon receipt. As such, receipt and/or detection of each signal 76 and/or 90 by the surface computer system 36 is not predicated upon a prior action within the signal stream 74 (e.g., drilling loop). The surface computer system 36 may thus be able to detect, for example, the resync signal 90 subsequent to a predetermined event (e.g., a state change in at least one downhole component of the drilling rig 10) at an undetermined time.

As an additional survey data series is not being transmitted, in some embodiments, the signal stream 74 may include the survey header signal 92, wherein the survey header signal 92 indicates to the surface computer system 36 that survey data is not being transmitted following the resync signal 90. Additionally, the drilling header signal 94 may be provided in the signal stream 74 for alerting the surface computer system 36 that drilling logging data will follow, and may also indicate what type of data may be transmitted within the second drilling data series 96. Transmission of the resync signal 90 and the second drilling data series 96 may be repeated as indicated by arrow 98. In some embodiments, once transmission of the second drilling data series 96 is complete, the signal stream 74 may immediately transmit another drilling data series 96 as indicated by arrow 95. In some embodiments, the additional drilling data series may be different (e.g., quantitatively or qualitatively).

In some embodiments, the data transmitted subsequent to the resync signal 90 may include an interruptible portion 99 wherein detection of the trigger event 88 causes the processor 44 to interrupt transmission of the signal stream 74. Generally, the interruptible portion 99 may include all signal transmission of the survey header 92, drilling header 94, and drilling data series 96.

Figure 6:
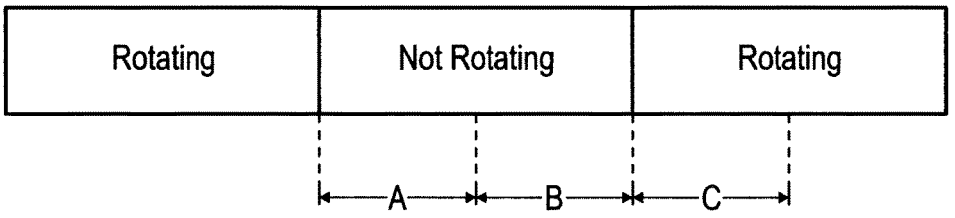
FIG. 6 illustrates an exemplary embodiment of a signal series for acquiring and transmitting survey data in accordance with the present disclosure.

Referring to FIG. 6, in some embodiments, survey data may be acquired and stored within the downhole computer system 40 during periods of time during cessation of rotation of the drill string 12 and/or drill bit 22 of FIG. 1. Additionally, transmission of survey data may be initiated at a pre-determined time after resumption of rotation. For example, as shown in FIGS. 2 and 6, cessation of rotation may serve as a trigger to the downhole computer system 40 to request acquisition of survey data from the sensors 38 for storage within the memory of the downhole computer system 40.

In some embodiments, a survey acquisition delay may be provided after cessation of rotation as indicated by section A. The survey data may then be acquired by the sensors 38 and provided to the downhole computer system 40 for accumulation and storage as indicated by section B. Resumption of rotation of the drill string 12 and/or drill bit 22 may then serve as a trigger for transmission of the accumulated survey data to the surface computer system 36 as shown in section C and as described herein.

Figure 7:
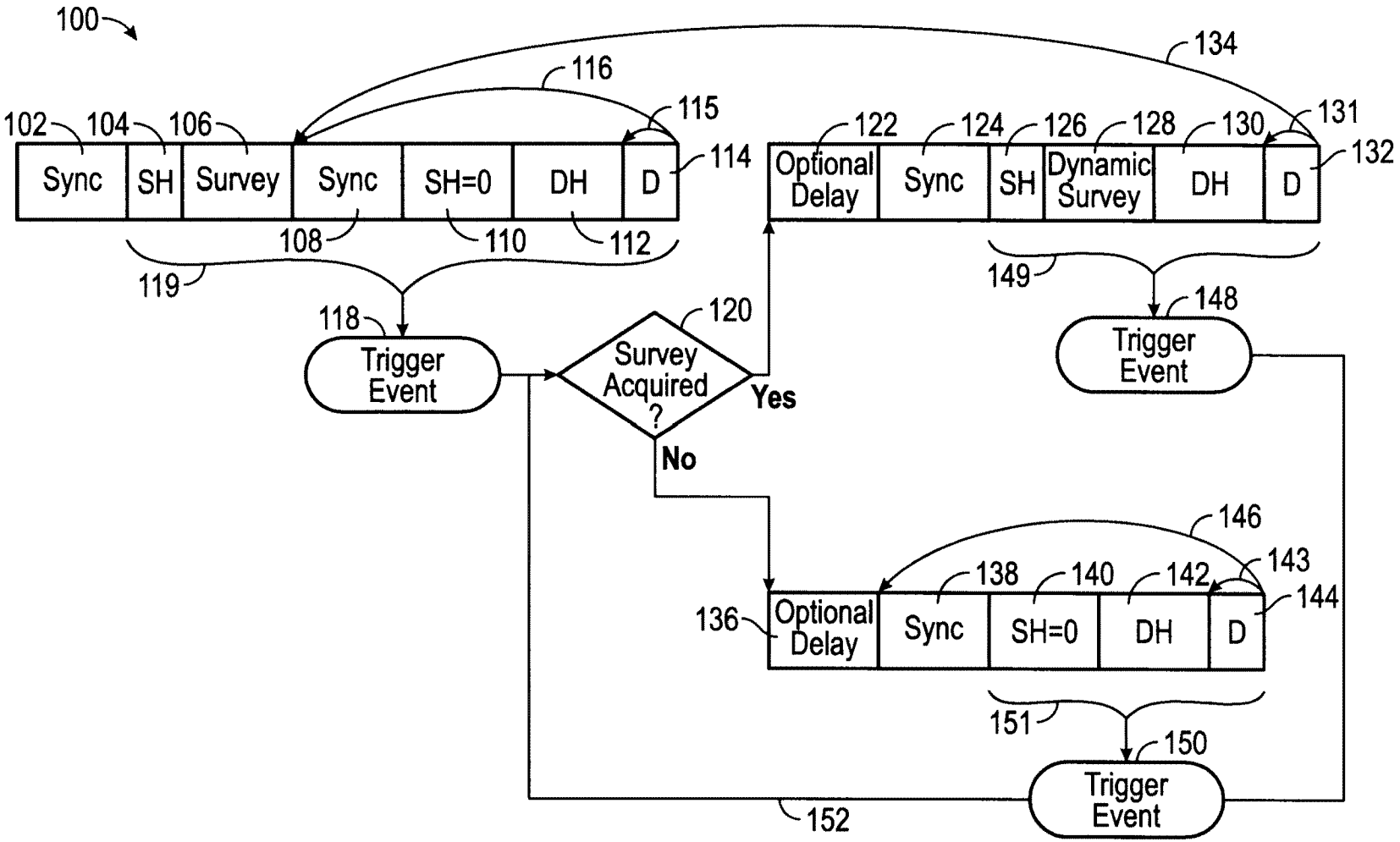
FIG. 7 illustrates an exemplary embodiment of another signal series for transmitting survey data and drilling data in accordance with the present disclosure, wherein transmission of survey data and transmission of drilling data is determinate on rotation change of a drill rig.

FIG. 7 illustrates logic for acquiring and transmitting data by the downhole computer system 50, as well as another exemplary signal stream 100 for acquiring and transmitting survey data and drilling data (e.g., tool face) from the downhole computer system 40 to the surface computer system 36. Trigger events (e.g., rotation change of the drill string 12 and/or drill bit 22) may serve as a trigger for transmitting updated survey and/or drilling data (e.g., tool face) to the surface computer system 36.

As illustrated in FIG. 7, the initiation of the signal transmission may include a sync signal 102. The sync signal 102 provides a reference for correlating time between the downhole computer system 40 and the surface computer system 36.

The signal stream 100 may include a header signal. For example, the signal stream 100, in FIG. 7, illustrate the header signal as a survey header signal 104 indicating to the surface computer system 36 that survey data will follow, and may also indicate what type of data may be transmitted within the survey data. Following the survey header signal 104 a first data series may be transmitted. For example, in FIG. 7, a first survey data series 106 may be transmitted in the signal stream 100. The first survey data series 106 may include one or more data orders including, but not limited to, inclination data, azimuth data, magnetic field data, gravity field data, and/or the like. In some embodiments, the first survey data series 106 may be a dynamic survey data series as described in further detail herein.

In some embodiments, the first survey data series 106 may be followed by a resync signal 108. The resync signal provides a secondary reference for correlating time between the downhole computer system 40 and the surface computer system 36. Additionally, the signal stream 100 may include a secondary header signal (e.g., survey header signal 110) indicating that the following transmission does not include survey data.

The signal stream 100 may include another header signal indicating the data to be received. For example, the signal stream 100 includes a drilling header signal 112. The drilling header signal 112, when transmitted, may indicate to the surface computer system 36 that a drilling data series will follow, and may also indicate what type of data may be transmitted within the drilling data series.

The drilling header signal 112 is followed by a first drilling data series 114 transmitted in the signal stream 100. The first drilling data series 114 may include drilling system orientation, and/or the like.

Once transmission of the first drilling data series 114 is complete, the signal stream 100 may immediately repeat the resynchronization (resync) signal 108, survey header signal 110, drilling header signal 112 and drilling data series 114 as indicated by arrow 116. In some embodiments, once transmission of the first drilling data series 114 is complete, the signal stream 100 may immediately transmit another drilling data series 114 as indicated by arrow 115.

During transmission of the signal stream 100, a trigger event 118 within an interruptible portion 119 of the stream may trigger acquisition and/or transmission of additional data series. For example, the trigger event 118 (e.g., rotation state change) may trigger acquisition and/or transmission of additional survey data series and/or drilling logging data series. In some embodiments, detection of the trigger event 118 may be a rotation state change determined by the downhole computer system 40. The downhole computer system 40 may then interrupt transmission of the survey header signals 104 or 110, the first survey data series 106, the resync signal 108, the drilling header signal 112, or the first drilling data series 114. Upon interruption, the downhole computer system 40 may determine whether a second survey data series 120 has been acquired and stored within memory 46 (e.g., survey data series collected at another location). If a second survey data series 120 is stored within memory 46, the processor 44 may store a placeholder indicative of the location in the signal stream 100 where the signal stream 100 was interrupted followed by transmission of the second survey data series 128 to the surface computer system 36.

Transmission of the second survey data series 128 may include one or more optional transmission delays 122 (e.g., sixty second transmission delay), a sync signal 124, and a survey header signal 126. Additionally, the second survey data series 128 may be followed by transmission of a drilling data series 132 proceeded by a drilling header signal 130. The drilling data series 132 may be different from the first drilling data series 114. In some embodiments, upon completion of transmission of the drilling data series 132, the signal stream 100 may resume at the resync signal 108. In some embodiments, once transmission of the drilling data series 132 is complete, the signal stream 100 may immediately transmit another drilling data series 132 as indicated by arrow 131. It should be noted that detection of another trigger event 148 (e.g., rotation change) during interruptible portion 149 may serve as a trigger 148 for another determination of survey acquisition 120.

The downhole computer system 40 may determine that updated survey data has not been acquired or stored within memory 46 after a change in rotation state 118. If updated survey data has not been acquired or stored within memory 46, the signal stream 100 may provide a drilling logging data series 144. In some embodiments, the drilling logging data series 144 may be different than the first drilling data series 114. Transmission of the drilling logging data series 144 may include an optional transmission delay signal 136 (e.g., sixty second transmission delay), a resync signal 138 and a drilling header signal 142. Additionally, a survey header signal 140 may indicate to the surface computer system 36 that a survey will not be provided in the immediate transmission. The transmission of the drilling data series 144 may be repeated as indicated by arrow 146. In some embodiments, once transmission of the drilling data series 144 is complete, the signal stream 100 may immediately transmit another drilling data series 144 as indicated by arrow 143. Transmission of the drilling data series 144 may be repeated until a trigger event 150 occurs during the interruptible portion 151 of the signal stream 100.

Figure 8:
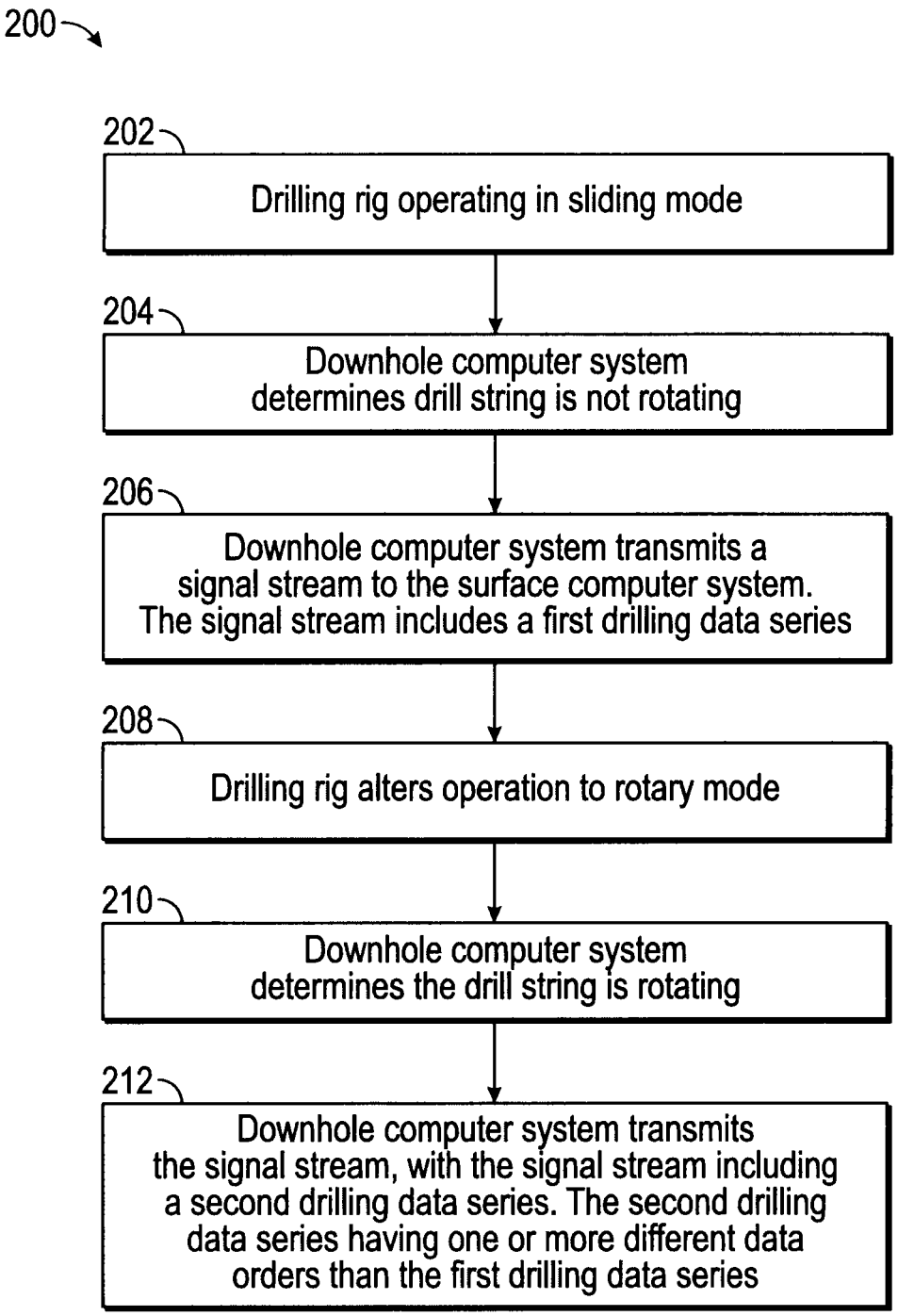
FIG. 8 is a flow chart of an exemplary method for triggering, acquiring and communicating data series within the MWD system during transition of a drilling rig from sliding mode to rotary mode.
Figure 9:
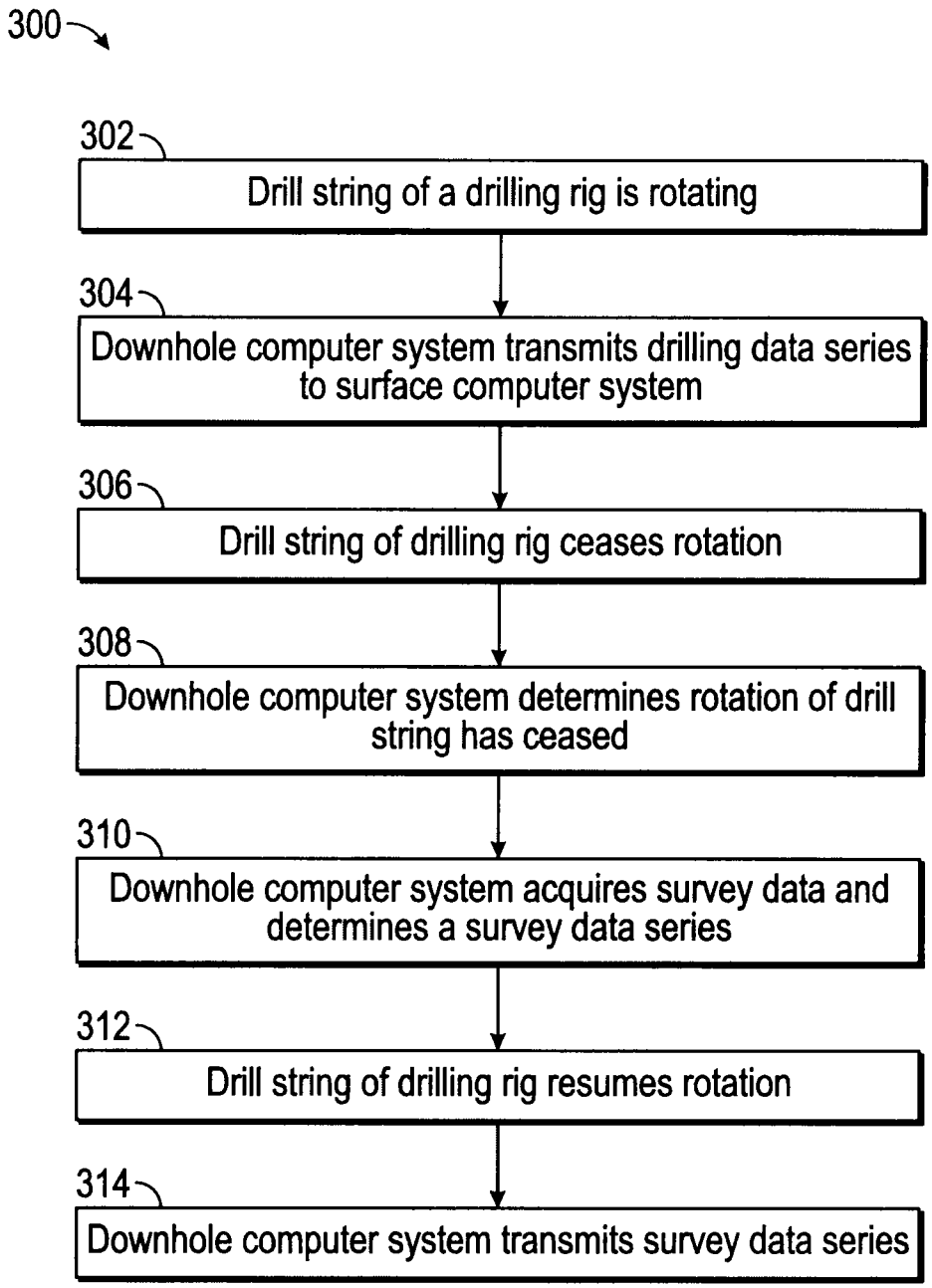
FIG. 9 is a flow chart of an exemplary method for triggering, acquiring and communicating data series within the MWD system during transition of a drilling rig from rotating to non-rotating.

FIGS. 8 and 9 illustrate flow charts of exemplary methods for triggering, acquiring and communicating data within the MWD system 34 using the systems and processes described herein.

Referring to FIG. 8, therein is illustrated a flow chart 200 of an exemplary method for triggering, acquiring and communicating data series within the MWD system 34 during transition from sliding mode to rotary mode of the drilling rig 10 using the signal streams described herein.

Each data series (e.g., survey data series, drilling data series) may include information for a particular time period of activity for the MWD system 34 in relation to sliding mode and rotary mode of the drilling rig 10. For example, in sliding mode, the downhole computer system 40 may determine that the drill string 12 is not rotating and send a first drilling data series using the signal streams described herein. In rotary mode, the downhole computer system 40 may determine that the drill string 12 is rotating and send a second drilling data series using the signal stream described herein. For example, a data order such as gamma readings may be provided in high density within the second drilling data series while in rotary mode; alternatively, a data order such as tool face angle may be provided in high density within the first drilling data series while in sliding mode.

In one example, in a step 202, the drilling rig 10 may be operating in sliding mode.

In a step 204, the downhole computer system 40 may determine the drilling rig 10 is operating in sliding mode and/or may determine the drill string 12 is not rotating.

In a step 206, the downhole computer system 40 may transmit a first signal stream to the surface computer system 36 as described herein. The signal stream may include a first drilling data series having one or more data orders.

In a step 208, the drilling rig 10 may alter operations to rotary mode.

In a step 210, the downhole computer system 40 may determine the drilling rig 10 is operating in rotary mode and/or may determine the drill string 12 is rotating.

In a step 212, the downhole computer system 40 may transmit the signal stream, with the signal stream including a second drilling data series. The second drilling data series may include one or more different data orders than the first data drilling data series.

FIG. 9 illustrates a flow chart 300 of an exemplary method for triggering, acquiring and communicating data series within the MWD system 34 during transition from a rotating drill string 12 to a non-rotating drill string of the drilling rig 10 using the signal streams described herein.

As described herein, the mud pump 26 may be maintained in a "flow-on" state to prevent the drill string 12 from getting stuck within the borehole 24, or to manage the drilling system pressure (i.e., managed pressure drilling). Additionally, in certain porous or fractured geology, drilling fluid may not be returned to the surface and lost circulation may occur. During a lost circulation event, however, fluid may continue to flow, although the mud pump 26 may be in an off state. As such, the downhole computer system 40 may detect rotation of the drill string 12 in order to trigger, acquire, and communicate data to the surface computer system 36 using the signal streams described herein.

For example, in a step 302, the drill string 12 of the drilling rig 10 may be rotating.

In a step 304, the downhole computer system 40 may be transmitting one or more drilling data series to the surface computer system 36.

In a step 306, the drill string 12 of the drilling rig 10 may cease rotating.

In a step 308, the downhole computer system 40 may determine rotation of the drill string 12 has ceased. In a step 310, the downhole computer system 40 may then acquire survey data to determine a survey data series.

In a step 312, the drill string 12 of the drilling rig 10 may resume rotation.

In a step 314, the downhole computer system 40 may transmit the survey data series.

From the above description, it is clear that the inventive concept(s) disclosed herein are well adapted to carry out the objects and to attain the advantages mentioned herein, as well as those inherent in the inventive concept(s) disclosed herein. While the embodiments of the inventive concept(s) disclosed herein have been described for purposes of this disclosure, it will be understood that numerous changes may be made and readily suggested to those skilled in the art which are accomplished within the scope and spirit of the inventive concept(s) disclosed herein.

What is claimed is:

1. A non-transitory computer readable medium running on a computer system and storing a set of instructions, the computer system having at least one processor, the set of instructions comprising:

instructions for extracting outputs from sensors of a measurement while drilling system of a drilling rig;

instructions for enabling a transmitter to transmit a first data stream from the extracted outputs, the first data stream having a drilling data series, the drilling data series having a plurality of transmission data orders, the first data stream having an interruptible portion encompassing at least a portion of the drilling data series; and, instructions for detecting a trigger event during transmission of the first data stream and immediately ceasing transmission of a transmitting data order of the plurality of transmission data orders upon detection of the trigger event, wherein said transmission is ceased such that a portion of the transmitting data order is not transmitted to a surface computer.

2. The non-transitory computer readable medium of claim 1, further comprising instructions for transmitting a second data stream from the extracted outputs.

3. The non-transitory computer readable medium of claim 2, wherein the second data stream includes a drilling data series different than the drilling data series of the first data stream.

4. The non-transitory computer readable medium of claim 1, further comprising instructions for providing a survey delay between the detection of the trigger event and the extraction of the outputs from the sensors resulting in acquisition of survey data.

* * * * *